United States Patent [19]

Graham et al.

[11] Patent Number: 4,879,821

[45] Date of Patent: Nov. 14, 1989

[54] INSOLE CONSTRUCTION

[75] Inventors: Kenneth Graham, Wakefield, Mass.; Kenton D. Geer, Exeter, N.H.; Katherine Bednarski, Amesbury, Mass.

[73] Assignee: Hyde Athletic Industries Inc., Peabody, Mass.

[21] Appl. No.: 94,483

[22] Filed: Sep. 4, 1987

[51] Int. Cl.[4] ..... A43B 13/38; A43B 13/40; A43B 21/32

[52] U.S. Cl. ..... 36/44; 36/37; 36/80; 36/91; 36/92; 128/581; 128/614

[58] Field of Search ..... 36/43, 44, 71, 76 C, 36/91, 92, 37, 80, 3 B, 76, 39; 128/581, 595, 614, 615

[56] References Cited

U.S. PATENT DOCUMENTS

| | | | |
|---|---|---|---|
| 532,429 | 1/1895 | Rogers | 36/3 B |
| 2,302,706 | 11/1942 | Margolin | 36/44 X |
| 4,120,102 | 10/1978 | Kenigson | 36/71 |
| 4,317,295 | 3/1982 | Hanson | 36/39 X |
| 4,503,576 | 3/1985 | Brown | 36/43 X |
| 4,510,700 | 4/1985 | Brown | 36/44 |
| 4,534,121 | 8/1985 | Autry | 36/43 X |
| 4,541,184 | 9/1985 | Leighton | 36/44 |
| 4,597,196 | 7/1986 | Brown | 36/44 |
| 4,619,056 | 10/1986 | Lin et al. | 36/43 |
| 4,718,179 | 1/1988 | Brown | 36/44 |
| 4,800,657 | 1/1989 | Brown | 36/44 |

FOREIGN PATENT DOCUMENTS

| | | | |
|---|---|---|---|
| 29361 | 12/1910 | United Kingdom | 36/37 |

*Primary Examiner*—James Kee Chi

*Attorney, Agent, or Firm*—Wolf, Greenfield & Sacks

[57] ABSTRACT

An insole construction for shoe comprising an insole layer having a forward portion, an instep portion having upwardly flared walls defining a flexible support for the wearer's instep, and a heel portion having upwardly flared peripheral walls defining a heel cup and having an enlarged opening through which a segment of the heel portion projects, and an insert positioned below and secured to the insole layer.

10 Claims, 2 Drawing Sheets

INSOLE CONSTRUCTION

The present invention relates to an insole construction, and more particularly, to an insole construction for use with a walking shoe.

BACKGROUND OF INVENTION

With the current interest in walking as a form of exercise, attention has been directed to the biomechanics of walking and the need to design shoes to accommodate stresses developed during walking. Although walking causes less stress on a person's foot and leg than running, there are, nonetheless, sufficient forces occurring particularly during long walks, to cause a person to become tired or perhaps even cause foot injuries.

Problems relating to walking for exercise center on the biodynamics involved. As a person walks, the outside heel strikes the ground first, causing the foot to assume a supernated position. The foot then rolls inwardly, pronating to a maximum position, before rolling outwardly again and supernating as it leaves the ground. Pronation occurs to varying degrees with every person. A limited amount of pronation does not ordinarily present a problem. However, injuries and excessive weariness will occur when there is excessive pronation. For that reason, there is a need for footwear that tends to limit the amount of pronation.

Another concern in designing walking shoes relates to vertical ground reaction forces. These forces develop between the foot and the ground each time the foot strikes the ground. While these forces are no more than one to one and a half times body weight when walking, as compared with three times body weight when running, the walking forces are applied over a longer period of time, because walking is a slower activity than running. For these reasons, less cushioning material is ordinarily needed for walking shoes than for running or aerobic shoes. In fact, walkers using running shoes may experience instability or discomfort because of excessive cushioning material.

The forces of walking also relate to the characteristics of pressure distribution patterns of the foot. In walking, the pressure distribution patterns starts with pressure at the rear heel area, then the mid foot or instep region, and finally under the metatarsal heads or ball of the foot. Thus, high forced distribution occurs under the heel, ball and first toe. A proper walking shoe must accordingly, reduce these forces by distributing them to other portions of the foot.

Another characteristic of walking is the dynamics that relate to the mid-foot area of the foot. Unlike running, the foot does not assume a rigid lever like system because of lower forces inherent in the walking motion. Thus, the intrinsic muscles of the foot must work harder to pull the foot bones together. Therefore, a properly designed walking shoe demands a snug support for the foot arch to avoid foot fatigue of the instep.

These biomechanical characteristics, including rear foot motion pattern, vertical ground reaction forces, pressure distribution patterns, and mid-foot dynamics are different in walking than running or other sports. It is these characteristics which require specific consideration in designing a walking shoe.

SUMMARY OF INVENTION

It is an object of the present invention to provide an insole construction particularly designed for use with walking shoes in which the insole construction can be fabricated as a separate element and adapted for a wide variety of shoe styles and designs.

A further object of the present invention is to provide an improved insole construction adapted particularly to cushion and properly support a wearer's foot in a shoe designed primarily for extensive walking.

A further object of the present invention is to provide an improved insole construction that provides significant anatomical stability and support as well as cushioning of the heel.

A further object of the present invention is to provide an improved insole construction that provides essential arch support necessary and useful to prevent or minimize foot muscle fatigue and to facilitate pressure distribution from the heel to the forefoot in a walking shoe.

A further object of the present invention is to provide an improved pressure dispersion pattern for a walking shoe, to achieve even distribution of pressure peaks that develop while walking.

Another object of this invention is to provide an improved means for controlling excessive pronation in a walking shoe.

One more object of the present invention is to provide an improved insole construction that conforms to the wearer's foot, provides adequate instep support and appropriate flexibility in selected portions of a walking shoe.

The foregoing objects and advantages of the present invention are achieved in an insole construction for a walking shoe that comprises an inner sole layer of resilient compressible material having a forward portion for supporting the ball of the foot and toes of the wearer, with the forward portion having segmented portions of substantial flexibility as well as a plurality of cushioning supports. The innersole layer is also provided with an instep portion for supporting the insole of a foot, and a heel portion for supporting the heel of the wearer. The heel portion which is thicker than the forward portion has upwardly flared walls defining a heel cup. A rigid insert positioned below and secured to the innersole layer has an instep section and a heel section. The instep section of the rigid insert has a width that is substantially at least one half the width of the instep portion of the innersole layer and provides torsional rigidity for the wearer's instep, with the torsional rigidity functioning to contol or limit pronation of the wearer. A heel section is formed with an enlarged opening and upwardly flared side walls. The upwardly flared walls of the heel section engage the side walls of the innersole layer at its heel portion. A segment of the heel portion projects through the enlarged opening of the heel section and forms a resilient pad having a plurality of cushion like projections that provide spring and centering support for the wearer's heel.

DESCRIPTION OF THE DRAWINGS

The foregoing objects and advantages of the present invention will be more clearly understood when considered in conjunction with the accompanying drawings, in which.

DETAILED DESCRIPTION OF THE PREFERRED EMBODIMENT

Figure 1:
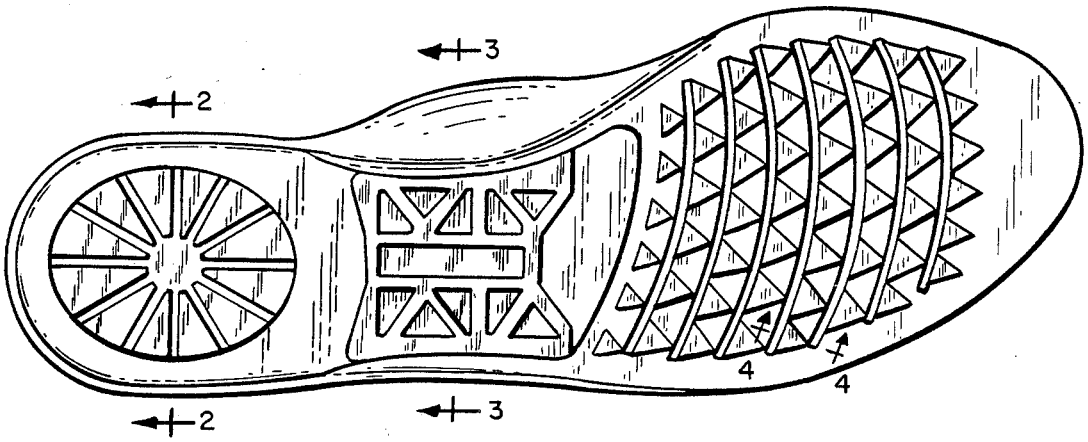
FIG. 1 is a bottom plan view of an insole construction embodying the present invention.
Figure 2:
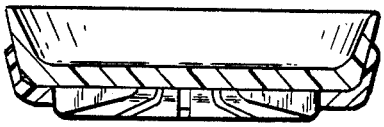
FIGS. 2, 3 and 4 are cross-sectional views taken respectively along lines 2—2, 3—3 and 4—4 of FIG. 1.
Figure 3:
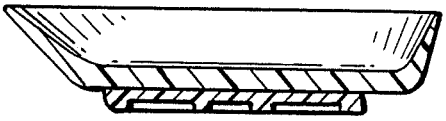
Figure 6:
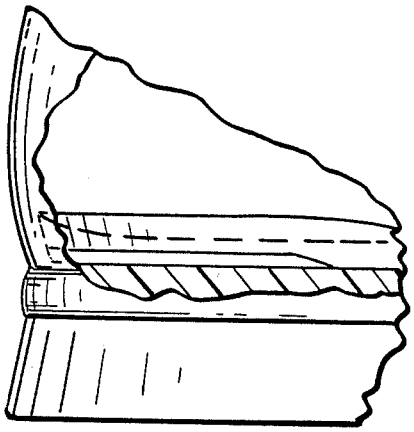
FIG. 6 is a partial fragmentary view of the insert as shown within a shoe construction.
Figure 7:
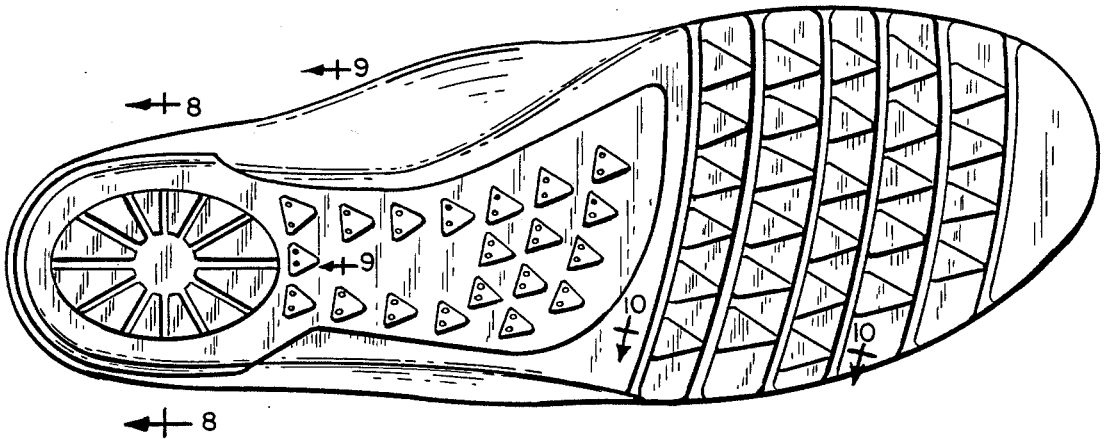
FIG. 7 is a bottom plan view of a modification of the present invention.
Figure 8:
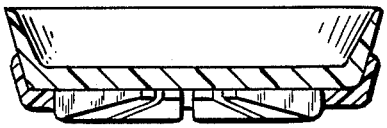
FIG. 8 is a cross-sectional view taken along lines 8—8 of FIG. 7.
Figure 9:
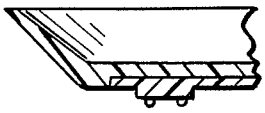
FIG. 9 is a cross-sectional view taken along lines 9—9 of FIG. 7.
Figure 10:
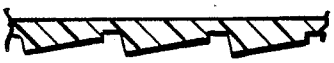
FIG. 10 is a cross-sectional view taken along lines 10—10 of FIG. 7
Figures 1, 2, 3, 4, 5, 6:
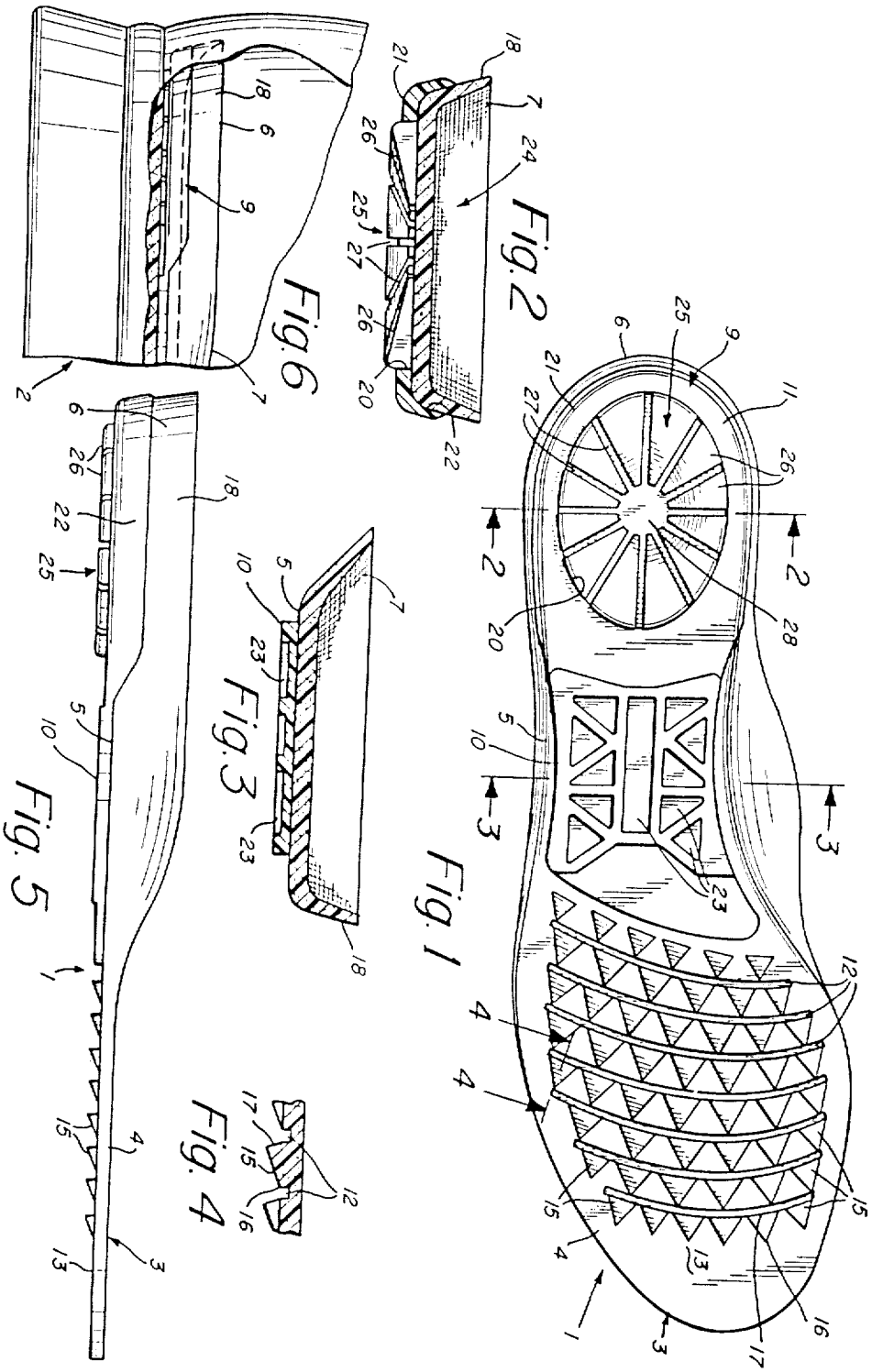
Figure 8:
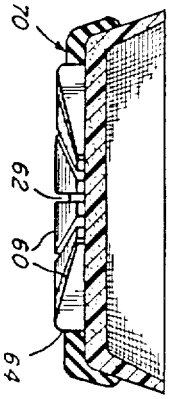
Figure 9:
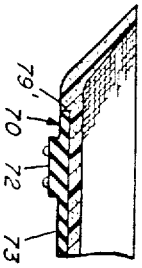
Figure 10:
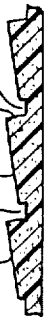
Figure 7:
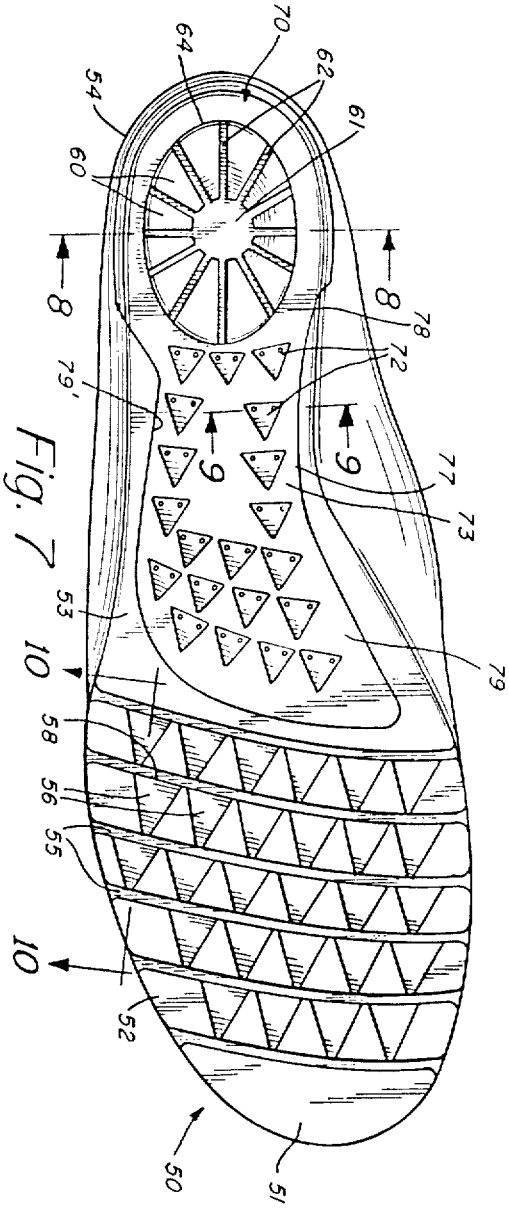

Referring to the preferred embodiment of FIG. 1, there is illustrated an insole construction 1 intended for insertion within a walking shoe 2 (FIG. 6). The insole construction 1 comprises an insole layer 3 of resilient compressible material having a forward portion 4, an instep portion 5, and a heel portion 6. The insole layer 3 may have laminated to its upper surface, a flocking or fabric layer 7 (FIG. 6) that is intended to be directly contacted by the wearer's foot. A rigid insert 9 is positioned below and is secured to the insole layer 3. The rigid insert 9 is formed with an instep section 10 and a heel section 11.

The forward portion 4 of the innersole layer supports the ball of a foot and the toes of the wearer. This forward portion 4 is formed with a plurality of arcuate grooves 12 that extend laterally across the lower surface 13 of the insole layer 3 in substantially parallel lines. These grooves 12 form flex points in the insole layer to facilitate flexing of the insole during normal walking.

Figure 4:
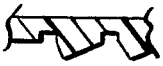
Figure 5:
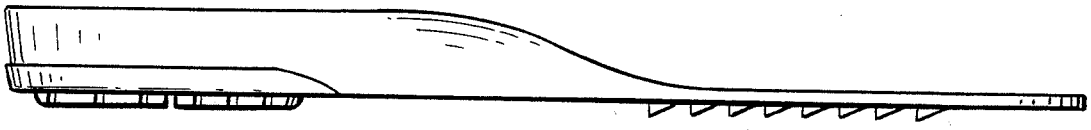
FIG. 5 is a side view of the insole construction.

The forward portion of the insole layer 13 is also formed with a plurality of equilaterally shaped triangular cushions 15, arranged in arcuate rows intermediate the parallel grooves 12. Each of these triangular shaped cushions 15 have one corner 16 of the triangle pointed forwardly, and the side 17 opposite this forwardly pointing corner parallel to and bordering an edge of a groove 12. The cushions 15 have a tapered thickness from maximum along the edges 17 to a minimum at the forward point 16 as illustrated in FIG. 4. Typically, the maximum thickness of the cushions 15 at side or edge 17 is in the order of 0.3mm., including the depth of the groove which may be in the order of 1.5mm. in thickness. The thickness of the inner layer at the forward portion exclusive of cushions may be in the order of 3.5mm. In a preferred embodiment, the edges of the triangular cushions 15 are in the order of one half inch long, although this length will vary with the size of the sole. The cushions may abut or be slightly spaced apart.

The insole layer 3 has a heel portion 6 designed to support the heel of the wearer. The heel portion 6 is provided with upwardly flared walls 18 at its periphery that define a heel cup. These walls 18 extend about the rear of the heel portion of the insole layer 3 and gradually taper to the thickness of the forward portion 4 of the insole layer 3. In the instep portion 5 of the insole layer, the wall 18 is substantially flared at the instep.

The rigid insert 9 is formed of a flexible, substantially stiff and non compressible plastic . It has a large, preferably oval opening 20 in its heel section 21. The heel section 11 is also formed with upwardly flared walls 22 about its sides and rear. These walls may typically have a height of 6mm. These upwardly flared walls 22, are intimately engaged with and secured to the walls 18. The walls 22 extend a minor fraction of the height of the walls 18 in the heel portion 6 of the insole layer 3, but nonetheless provide a rigid support at the heel for the cup like shape 24 defined by the walls 18. The insert 9 may also be formed with a plurality of recesses 23 in its bottom surface that are in the order of 0.5mm deep, thereby forming reenforcing ribs in the insert 9.

A segment 25 of the heel portion projects through the enlarged opening 20. This segment projects downwardly and forms a cushion for the wearer s heel. The segment 25 is preferably formed with a series of pie like projections 26 defined one from the other by a series of radial channels 27. These pie like projections 26 are thickest about the periphery of segment 25 with a thickness in the order of 2mm feathered toward the center 28. The thickness of the insole layer at the heel portion is in the order of 5 or 6mm, in addition to the thickness of the projections 26. The plurality of pie-like projections form a cushion support that initially compresses on initial ground contact at its periphery and then compresses toward its center 28.

Referring now to the embodiment of FIG. 7-10, there is illustrated an insert 50 designed for larger shoes. The insert includes an insole layer 51 having a forward portion 52, instep portion 53, and heel portion 54. Arcuate grooves or channels 55 define flexing points for the insole construction in the forward portion 52. Intermediate parallel grooves or channels 55 are a plurality of cushions 56 having equilateral shapes. In this embodiment, the height of the cushions 56 at the edges 58 bordering the channels, preferably in the order of 1mm. and taper to feathered edge at the next forward channel 55. The overall thickness of the insole layer 52 at the forward portion is preferably in the order of 3mm. This thickness increases to preferably in the order of 6mm. in the instep portion, but is reduced in thickness in the heel portion to approximately 5mm. other than for the thickness of the pie-like projections 60. These pie like projections 60 integrally formed at the heel portion of the insole layer are radially arranged about a center portion 61, having a thickness in the order of 5mm. These pie like segments are divided one from the other by channels 62. The thickness of the pie like segments 60 at their peripheral edges 64 are in the order of 2mm.

The rigid insert 70 is generally similar in configuration to the peripheral configuration of insert 9 of the embodiment shown in FIG. 1. This rigid insert 70, however, is provided with a plurality of projecting cushion-like members 72 arranged preferably in a series of rows in the instep section 73 of the insert 70. The insert 70 is preferably made of a material slightly more flexible than the rigid insert of FIG. 1. Insert 70 may be made of a relatively dense rubber or synthetic rubber material, such as EVA, with this insert 70 having less compressibility and a greater stiffness than the insole layer 50.

The insert 70 has a peripheral shape that includes a relatively narrow waist 77, intermediate the heel section 78 and the forward portion 79. The insert 70 forms a support under the instep, and is sized to extend forwardly in the assembly to a point just behind the ball of the wearer's foot.

In the preferred embodiment, the insert 70 is intimately secured to the insole layer 50 within a recess 79 formed on the bottom surface of the insole layer 50. The insert 70 may have a thickness in the order of 2mm. Preferably, the pie-like projections 60 project beyond the outer surface of the insert in the heel region, a distance of in the order of 2mm.

The cushions like members 72 formed on the lower surface of the insert 70 are preferably in the order of 10mm. long on each side and have a height in the order of 1mm. at the rear edge tapering to a thickness of no more than approximately 0.5mm. at the forward edge.

We claim:

1. An insole construction for a walking shoe and the like comprising an insole layer of resilient compressible material having a forward portion for supporting the ball of the foot and toes of a wearer, an instep portion for supporting the instep of the foot and a heel portion for supporting the heel of the wearer; said heel portion having upwardly flared peripheral walls defining a heel cup and said instep portion having upwardly flared peripheral walls defining a flexible support for a wearer's instep and with the peripheral walls of the instep portion projecting outwardly more on the medial than the lateral side of said insole construction;

an insert having a greater stiffness and less compressibility than said insole layer positioned below and secured to said insole layer and having an instep section and a heel section, said instep section having a width that is at least ½ but less than the width of said instep portion whereby pronation by the wear may be controlled;

said heel section formed with an enlarged opening through which a segment of said heel portion projects, said heel section having an upwardly flared sidewall engaging the sidewall of said heel portion of the lower periphery thereof providing support for the lower of said flared walls.

2. An insole construction as set forth in claim 1 wherein said heel portion has a segment extending through said enlarged opening and said segment comprises cushion means of a resilient compressible material projecting beyond said insert and providing a cushion for the heel.

3. An insole construction as set forth in claim 2 wherein said cushion means has a periphery having a thickness greater than the thickness at the center of said cushion means.

4. An insole construction as set forth in claim 2 wherein said cushion means is formed of a plurality of pie-like segments defined from one another by radial channels and with said pie like segments having a thickness at their outermost side that is greater than the thickness at the corner opposite thereto.

5. An insole construction as set forth in claim 3 wherein the flared wall of said heel section has a height that is a minor fraction of the height of the flared walls of said instep layer in the heel portion.

6. An insole constructions as set forth in claim 1 wherein said forward portion of said insole layer is formed with a plurality of segmented portions defined by a plurality of annular grooves extending arcuately across said forward portion and defining a plurality of flexible portions, and a plurality of cushioning supports integrally formed on and projecting from the lower surface of said forward portion.

7. An insole construction as set forth in claim 6 wherein said cushioning supports are triangular in shape and tapered in thickness from one edge to the opposite corner.

8. An insole construction for a walking shoe comprising an insole layer of compressible resilient foam material having forward, instep and heel portions, said heel portion having a segment projecting therefrom and forming a downwardly projecting heel cushion with a peripheral thickness greater than the thickness at the center thereof and with the lowermost point at the center above the periphery of the heel cushion and said heel cushion formed of a plurality of discrete segments by radially extending channels in said insole layer.

9. An insole construction as set forth in claim 8 having an insert having greater stiffness and less compressibility than said insole layer, said insert formed of a sheet of material having a thickness in the order of 1mm. to 2mm. and having an opening through which said heel cushion projects to a distance beyond said insert of substantially no more than in the order of 2mm.

10. An insole construction as set forth in claim 8 wherein the lower surface of said forward portion is formed with a plurality of downwardly projecting triangular shaped cushions having a tapered thickness.

* * * * *

UNITED STATES PATENT AND TRADEMARK OFFICE

CERTIFICATE OF CORRECTION

PATENT NO. : 4,879,821

DATED : November 14, 1989

INVENTOR(S) : Kenneth Graham, et al

It is certified that error appears in the above-indentified patent and that said Letters Patent is hereby corrected as shown below:

The drawing sheets, consisting of Figs. 1 - 10, should be deleted to be replaced with the drawing sheets, consisting of Figs. 1 - 10, as shown on the attached pages.

Signed and Sealed this

Seventeenth Day of May, 1994

*Attest:*

Bruce Lehman

BRUCE LEHMAN

*Attesting Officer*

*Commissioner of Patents and Trademarks*